United States Patent [19]

Stoddard et al.

[11] Patent Number: 4,463,807

[45] Date of Patent: Aug. 7, 1984

[54] MINIMIZING SUBSIDENCE EFFECTS DURING PRODUCTION OF COAL IN SITU

[75] Inventors: Xerxes T. Stoddard, Denver; Vesper A. Vaseen, Wheat Ridge; Ruel C. Terry, Denver, all of Colo.

[73] Assignee: In Situ Technology, Inc., Golden, Colo.

[21] Appl. No.: 479,830

[22] Filed: Mar. 28, 1983

Related U.S. Application Data

[62] Division of Ser. No. 273,378, Jun. 15, 1981, Pat. No. 4,437,520.

[51] Int. Cl.[3] ..... E21B 33/00

[52] U.S. Cl. ..... 166/285; 166/241

[58] Field of Search ..... 166/241, 173, 285–295; 175/325, 290; 308/4 A

[56] References Cited

U.S. PATENT DOCUMENTS

| | | | |
|---|---|---|---|
| 3,354,956 | 11/1967 | Critz | 166/292 |
| 3,439,744 | 4/1969 | Bradley | 166/295 |
| 3,650,327 | 3/1972 | Burnside | 166/292 |
| 3,924,680 | 12/1975 | Terry | 166/295 |

*Primary Examiner*—Ernest R. Purser
*Assistant Examiner*—Mark J. DelSignore
*Attorney, Agent, or Firm*—Ruel C. Terry

[57] ABSTRACT

Coal is reduced to ash in place by gasification using in situ production techniques, resulting in significant void space underground, which in turn causes roof fall and subsidence. Overburden collapse is stabilized by back-filling with foaming mud cement that hardens into an expanded solid, which quenches and fills the production module and seals residual ash. Rubble volumes and subsidence cracks are sealed against water incursions and contaminated water excursions. Surface facilities above barrier pillars are protected from destructive forces of subsidence draw.

3 Claims, 11 Drawing Figures

MINIMIZING SUBSIDENCE EFFECTS DURING PRODUCTION OF COAL IN SITU

This is a division of application Ser. No. 273,378 filed June 15, 1981 now U.S. Pat. No. 4,437,520.

FIELD OF THE INVENTION

This invention relates to production of coal in situ wherein coal is set afire and consumed in place with energy values captured in surface facilities. More particularly the invention is directed to the integrity of the underground reaction zone during roof falls and subsidence, occasioned by creation of void space underground, as the coal is consumed in place.

BACKGROUND OF THE INVENTION

It is well known in the art how to produce coal in situ, such production having been accomplished on a commercial scale in Russia for more than 30 years. While not yet practiced commercially in the United States, numerous field tests in various parts of the country point to an emerging commercial industry. For production of coal in situ, wells are drilled from the surface of the earth into an underground coal seam, linkage channels are established through the coal thus connecting the wells in pairs, the coal is set afire with combustion sustained by injection an oxidizer into one well of the pair and removing the products of reaction through the other well of the pair. Useful products recovered include carbon monoxide, hydrogen, methane and condensible liquids that contain valuable coal chemicals.

In commercial practice a multiplicity of wells is drilled into the coal seam providing numerous pairs of wells. Generally each well during its useful life will be operated both as an injector well as a producer well until a maximum amount of coal is consumed within the influence of the well. Preferably the pairs of wells are linked through the coal at the bottom of the seam. When the coal is set afire, the fire propagates along the linkage channel under pressure and thus establishes an underground reactor in the coal seam. Unlike an aboveground pressure vessel used for gasifying coal which is fixed in size by design, the underground reactor (sometimes called a georeactor) begins as a relatively small pressurized volume in the linkage channel and grows in size as coal is consumed. A properly operated georeactor grows in length from the ignition point and expands laterally and vertically as combustion proceeds. With properly placed wells and linkage channels at the bottom of the seam, it is possible to consume virtually all of the coal seam during production sequences.

In the interest of maximum resource recovery, it is important that the seam be consumed from bottom to top. In this mode fresh fuel remains above the fire and residual ash below the fire. As combustion proceeds and the georeactor grows in lateral extent, the natural structure of the coal seam weakens and fresh coal spalls into the fire, such spalling continuing on an intermittent basis until all of the coal above the fire is consumed. Continuing growth of georeactor size results in additional underground void space with loss of support for the overburden and resultant roof fall from the overlying rock strata. When the overlying rock strata becomes dislodged, spalls and falls into the georeactor, such disturbance of overlying rock is generally characterized as roof fall within a vertical distance of twice that of the coal seam thickness. For greater vertical distances disruption of the overburden is generally characterized as subsidence.

From a process efficiency point of view, it is desirable to contain the pressurized georeactor within the coal seam. From a resource recovery point of view, it is desirable to consume all of the coal within the influence of the wells. Thus an economic tradeoff is established trending toward maximum resource recovery, with attendant problems of roof fall and subsidence. Roof fall generally is a relatively minor problem that expands the pressurized georeactor into the overlying rock strata, exposing cool rocks that rob heat from the reactor. Subsidence is a more severe problem, particularly when the disturbed area intersects an overlying aquifer or propagates cracks to the ground surface. An overlying aquifer connected to a georeactor can result in quenching all useful reactions in the reactor. Cracks to the surface result in serious losses of pressure and produced gases. It is apparent that a relatively small in situ coal project will encounter the problems of roof fall. A project of commercial size will encounter problems both from roof fall and subsidence. A successful commercial project must cope with and manage the problems of subsidence.

Subsidence has been a recognized problem for conventional underground coal mines since the industry began several centuries ago. Numerous studies through the years have contributed to the understanding of the forces of subsidence, which have made possible reasonably standardized designs for mine safety, the mine plan and the sequence of operations. In virtually all cases the designs require modification to the site specific requirements of a new mine. For conventional coal mines the planned amount of void space underground can be carefully controlled. For in situ production of coal, precise control of void space is difficult to attain. To provide a plan for mining sequence in each case, it is necessary to obtain information about the rock strata overlying the coal seam. It is well known that tests on rock cores result in strengths much higher than the actual strength of the rock mass. Test results of compressive strengths may approach the actual strength of the rock mass, but tensile strengths can vary considerably due to faults, joints and bedding planes.

Once a substantial void space is opened up by removing a portion of the underground coal, the overburden above the void must be supported by adjacent coal. The result is the establishment of a compression arch from the adjacent coal to an apex located above the center of the void. Overburden rock within the lower boundary of the compression arch thus becomes destressed and remains in place only if there is sufficient tensile strength to overcome weight of the destressed rock. Chances are good that there will be discontinuities in the destressed rock. Thus roof fall will begin with a chuck of rock falling into the void space. Later in time another chuck of rock will fall, then another and another, resulting in an upward stoping process that may continue intermittently for months or years. The vertical extent of this upward stoping may be approximated by the width of the underground void space.

When the width of the void space exceeds the depth of the overburden, upward stoping probably will continue to collapse of the surface of the ground. Arrival of upward stoping at the ground surface normally appears without warning in the forms of a depression, pit, trough, tension crack and the like. Normally any lowering of the earth surface due to subsidence also will be accompanied by compression bulges near the center of the lowered surface. Another feature commonly occuring with surface collapse is the amount of area disturbed at the surface, generally a larger area than that of the underground void that initiated the sequence. The added area is commonly called the draw, being induced by the tensile strength of the rock which has moved into the disturbed zone. When it is known that underground void space is likely to result in ground surface depression, care should be taken in locating manmade structures above the void plus the expected draw. The expected depression area should be placed under limited access control until the disturbed area becomes stabilized.

The changing size of the georeactor can be reasonably well controlled until significant subsidence is underway. It is highly desirable to maintain the pressurized space associated with the georeactor to the confines of the coal seam and immediately adjacent void space. It is apparent that upward stoping will significantly increase the vertical dimension of the reactor, thus it is highly desirable to place a pressure seal on the changing void space resulting from rock fall. Methods of accomplishing such a seal will be described hereinafter. Such a seal also is highly desirable to be in place before upward stoping encounters an overlying aquifer. A seal against water incursion serves two purposes: water is excluded from the georeactor and the processes underway, and water soluble products of reactions (phenols, ammonia and the like) are excluded from the aquifer.

As previously mentioned production of coal in situ is accomplished by operating wells in pairs. The initial group of individual georeactors (sometimes called modules) will be located between each pair of wells. As production proceeds many of the reactors will merge, and at the point of merger it is desirable that subsidence be accelerated to lower the overburden into the void space, and to place pressure seals to restrict georeactor size. Accelerated subsidence can cause substantial damage to manmade structures within the disturbed area, specifically the injector-producer wells of the project. Special protection is required for these wells as will be more fully described hereinafter. Further, accelerated subsidence is desirable when the in situ production project contains multiple seams of coal and it is planned to produce an underlying seam without undue delay. In the ideal case the original production wells will have survived the forces of subsidence and are deepened for production of the lower seam. Accelerated subsidence can be induced by widening the underground void spaces to the maximum extent of the planned production area.

A planned production area normally will be somewhat smaller than that defined by the perimeter of the property. It is common practice to leave unproduced coal within the outer boundaries of the mine property, a barrier pillar within the perimeter, for example a strip of unmined coal 150 feet wide. For conventional underground mining, the location of the barrier pillar can be positioned with accuracy. For in situ production of coal the barrier pillar will be uneven on the inside, due to imprecise dimensions of the georeactors paralleling the property line, thus leaving slightly more coal in the barrier pillar than for conventional mining. Also for in situ coal production the spans of the underground void space can be quite long, virtually assuring subsidence to the surface. In order for the ground surface immediately over the barrier pillar to remain intact, it is necessary to take steps to minimize the effect of subsidence draw in the barrier area. Likewise, a barrier pillar is established under the area of the property used for offices, shops, compressors, gas clean up facilities, and other above-ground facilities that are used in support of the project. Steps also must be taken to minimize the effect of subsidence draw on this set-aside surface area.

Generally the preferred coals for in situ production are those of lower rank, subbituminous and lignite, which are more reactive than higher rank coals. In the United States most of the reserves of reactive coals are located in western states where it is common that the coal seams are overlain and innerbedded with shale. Generally these shales are relatively soft and pliable, characteristics that facilitate minimizing the effects of subsidence in that subsidence cracks frequently will heal and seal in the pliable shale under the influence of the weight of the overburden. It is quite common in western coals that the coal seam itself is an aquifer. Wet seams require dewatering prior to in situ combustion, a circumstance that is both an advantage and a disadvantage. Water recovered from the seam can be used in the in situ production processes, a desirable feature in the arid west. On the other hand, the relatively low permeability of the wet coal seam introduces difficulties in the drawdown of flowable water. Without adequate drawdown a portion of the seam remains relatively wet while another portion, generally the upper portion in flat lying seams, is relatively dry. Once the seam is ignited, the propagating fire tends to flourish in the upper part of the seam, eventually engulfing itself in its own ashes and bypassing the coal underneath. Steps should be taken to control this flame override situation as will be further described hereinafter.

By way of example the present invention will be directed to coals in the western United States. In the prior art dealing with conventional underground coal mining and resulting subsidence, recent comprehensive reports include U.S. Geological Survey Professional Paper 969, Some Engineering Geological Factors Controlling Coal Mine Subsidence in Utah and Colorado (1976) and U.S. Geological Survey Professional Paper 1164, Effects of Coal Mine Subsidence in the Sheridan, Wyoming, Area (1980). Recent art involving subsidence associated with in situ coal gasification include U.S. Department of Energy Report UCRL-52255, Ground Subsidence Resulting from Underground Gasification of Coal (1977) and U.S. Department of Energy Report UCRL-50026-79-4, LLL In Situ Coal Gasification Project, Quarterly Progress Report, October through December 1979.

In establishing the georeactor in the coal seam, linkage may be accomplished between wells by any convenient method, but preferably is accomplished using the methods of U.S. Pat. No. 4,185,692 of Terry. Likewise in situ production of coal may be accomplished by any convenient method, but preferably is accomplished using the methods of U.S. Pat. No. 4,114,688 of Terry. Additional methods of sealing a georeactor are taught in U.S. Pat. No. 4,102,397 of Terry.

SUMMARY OF THE INVENTION

Coal is produced in situ using a series of georeactors between pairs of wells. Georeactors enlarge as coal is consumed resulting in loss of support structure for the overburden with attendant roof fall and subsidence. A foaming mud cement is used to maintain georeactor integrity, thus minimizing product gas leakage and ground water contamination during production, and facilitating module quenching when production is terminated.

DESCRIPTION OF THE PREFERRED EMBODIMENTS

Figure 1:
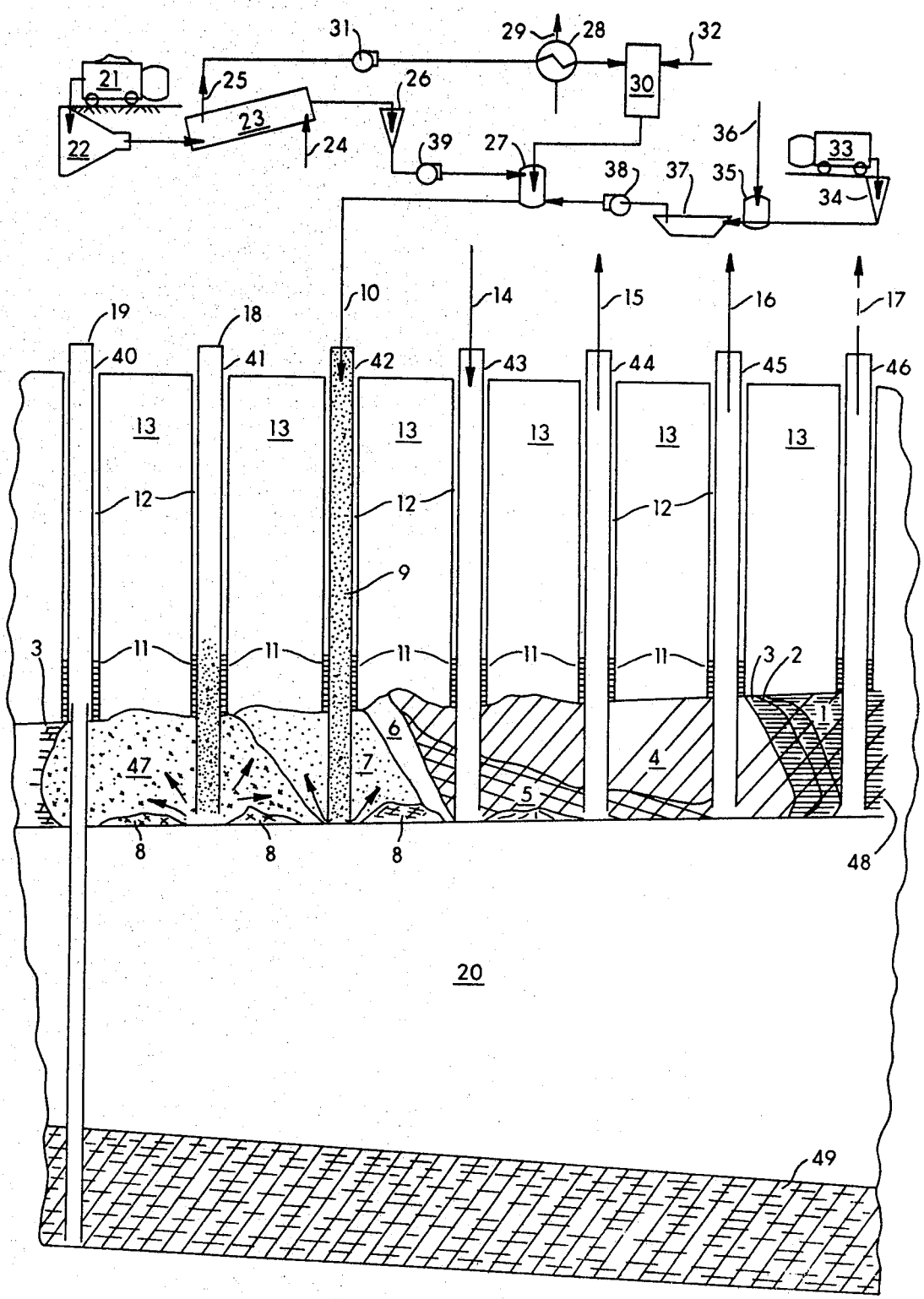
FIG. 1 is a diagrammatical vertical section through the earth showing a series of wells in various stages of the methods of the invention, together with arrangement of aboveground equipment.

Referring to FIG. 1, a series of production wells 40–46 has been drilled from the surface of the earth through overburden 13 and into upper coal seam 48. The production plan calls for producing coal seam 48 in its entirety, then deepening the wells through interburden 20 into coal seam 49 for continued production. In upper coal seam 48 production has been underway for a period of time with georeactors established between pairs of wells. Coal 1 adjacent to well 46 is virgin coal, not yet affected by heat. Coal 2 has been affected by heat to the extent that it has been dehydrated. Coal 3 is in the early stages of pyrolysis. Coal 4 is sufficiently warm for active pyrolysis. Coal 5 is undergoing combustion. Void 6 remains after coal has been reduced to ash. Fluid foaming backfill material 7 is in the process of becoming solidified. Rubble 8 is composed of residual ash and overburden roof-fall. Backfill material 47 is solidified.

By way of example, coal seam 48 is located 500 feet below the surface of the earth with an average seam thickness of 25 feet and coal seam 49 is located at an average depth of 1000 feet and has a thickness of 50 feet. As shown in FIG. 1 well 40 has produced all of coal seam 48 within its influence and has been deepened into coal seam 49 in preparation for additional production. Likewise well 41 has completed its purpose for coal seam 48 and is ready for deepening into coal seam 49, at which time a georeactor can be established between wells 40 and 41 in lower coal seam 49. Well 42 is receiving backfill material to fill the void remaining after coal has been consumed.

The georeactor is active between wells 43 and 44, with reactants 14 being injected into well 42 and products of reaction 15 being withdrawn from well 44. Preferably the reactants are alternating injections of air and steam. Products of reaction during air injection is a low BTU gas composed principally of hydrogen, carbon monoxide, carbon dioxide and nitrogen. Products of reaction during steam injection is water gas ($H_2+CO$), a useful product for synthesis into a host of useful products such as methane, methanol, naphtha, various oils and the like. Well 45 is producing at a low volume, mainly hot gases of pyrolysis with well 46 in a standby status for future production. When the georeactor between wells 43 and 44 grows to substantially the top of coal seam 48, well 43 is shut in, well 44 is converted into an injector well and well 45 becomes an active producer with products of reaction from the georeactor between wells 44 and 45. At this time backfilling operations will have been completed in well 42 and backfilling begins in well 43.

A major in situ coal production project will require a large volume of sealant material, and preferably the raw materials for such sealants are located on site or nearby. The volume of solid raw materials required can be reduced substantially by mixing the solids with water that is saturated with carbon dioxide, as will be more fully described herein. The resulting mud cement is then injected into the underground void under sufficient pressure to maintain water in the liquid phase until the mud is substantially in place as planned. Solid raw materials include lime and/or magnesium cement materials. The underground void space is relatively hot due to residual heat from coal production. Preferably only a portion of the void space is filled with mud, for example one half of the volume. Residual heat causes the water to flash to steam with the resultant release of carbon dioxide as gas, the combination causing the mud to foam and then congeal into concrete, filling the void completely. An abundance of carbon dioxide, that otherwise would be vented to the atmosphere, is available on site from the production processes. Likewise an abundance of waste heat is also available for the processes of the present invention.

Referring again to FIG. 1, raw calcareous materials 21 are delivered to a crusher 22 with the crushed material delivered to a kiln 23 for calcining into clinkers. Heat 24 is added to the kiln and carbon dioxide 25 is withdrawn from the kiln 23. Carbon dioxide 25 is then compressed and sent to heat exchanger/cooler 28 and then to absorber 30 where water 32 is introduced as the carrier liquid for absorbed carbon dioxide. Clinker from kiln 23 is directed to pulverizer 26 for sizing of the cement clinkers, with the sized material then transferred 39 to mixer 27. A suitable mud material 33, for example native clay, is directed to pulverize 34 with the sized material then directed to mixer 35 where water 36 is added to make mud, which in turn is stored in mud pit 37. At mixer 27 cement from pulverizer 26, water supersaturated with carbon dioxide from absorber 30, and native mud from pit 37 are then mixed, with the resultant mixture, sometimes called sealant mud, then injected 10 through well 42 into the underground formation 7. Such injection is made under pressure as previously described until the planned volume of sealant mud is in place underground. Underground pressure is then reduced by backing off on the pressure maintained in well 42 with the resultant foaming and congealing of mud 7, also as previously described. Thus an underground seal is established that assists in stabilizing the overburden and such seal also filling a void space that might otherwise be linked to an adjacent georeactor.

No particular novelty is claimed in making cement from calcareous materials or for making mud from native materials. It will be appreciated, however, that the resulting soil cement saturated with carbon dioxide serves several purposes underground including reduction of underground temperatures below the ignition temperature of adjacent coal thereby quenching the spent georeactor and preventing an unplanned burn in adjacent coal, the released carbon dioxide serves to expand the volume of the sealant mud and promotes rapid setting of the expanded sealant mud, and the conversion of sealant mud water to steam for further expansion of the sealant mud prior to formation of concrete. A further advantage of the congealed sealant mud is that residual ash from burned coal is sealed from water incursion should the spent georeactor become a part of an aquifer during the post production period. It will be further appreciated that all wells drilled into coal seam 48 will have proper wellhead fittings (not shown) for maintaining planned pressures underground as well as for injection and recovery of the various fluids described herein, and that each well will have suitable hermetic seals for the casing. The spacing between wells is determined by procedures common in production of coal in situ.

In drilling production wells for a project that is expected to have severe subsidence problems, it is important that each well be provided with protection from subsidence effects. Generally this means that the well column be strengthened against bending of the casing from vertical and horizontal loads. It is highly desirable that the casing survive earth shifts and that the casing remain intact during lowering of the surrounding overburden. Further the casing should be protected from excessive heat generated in georeactors. To these ends a suitable casing is selected with additional protection being provided for a proper filling material between the installed casing and the well bore.

Figure 2:
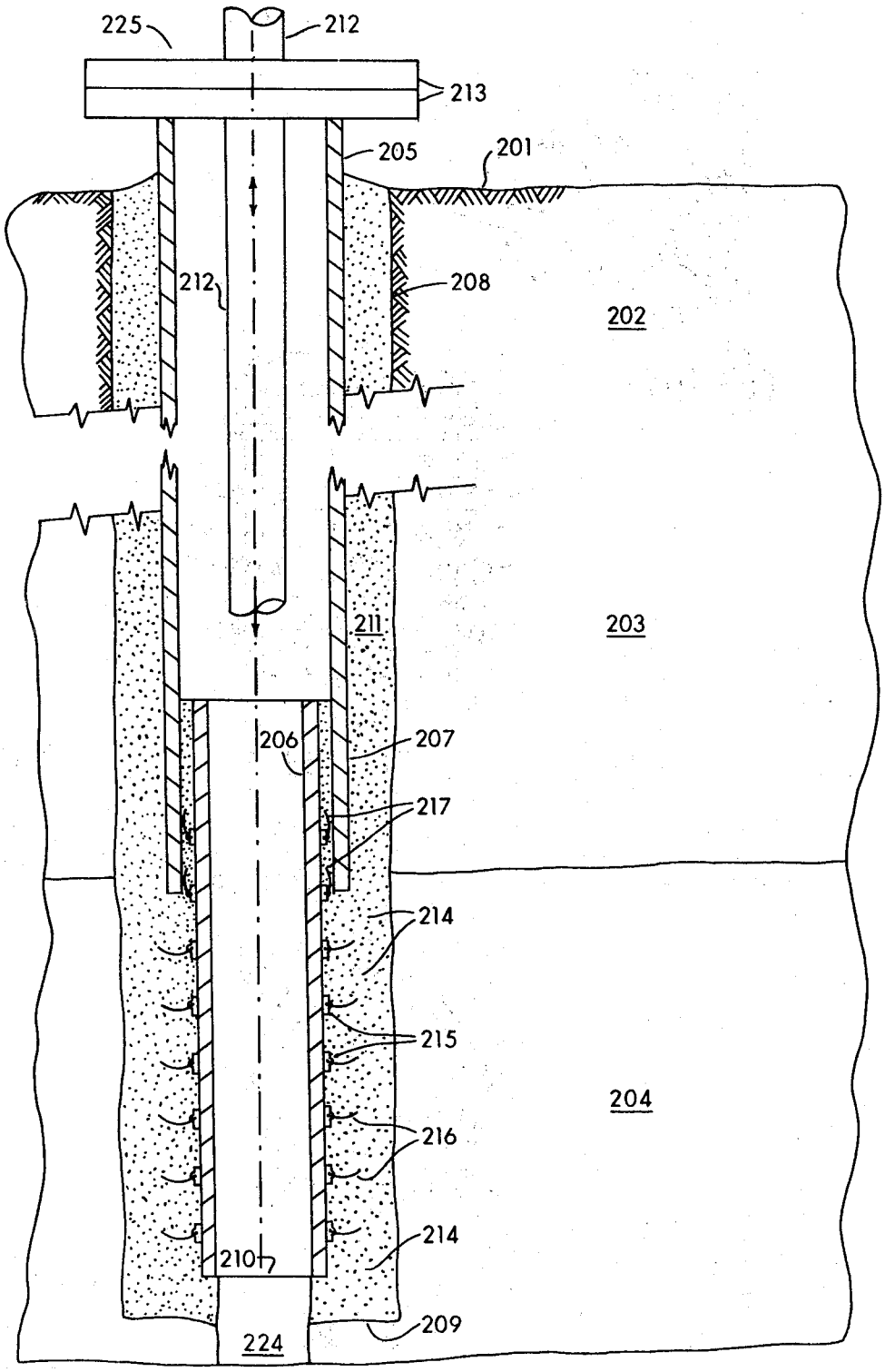
FIG. 2 is a diagrammatical vertical section through the earth showing a well with conductor pipe cemented to the ground surface and a lower bob-tailed string of casing cemented to the bottom of the hole with attached bonding apparatus.

Referring to FIG. 2, well 225 is drilled from the surface of the earth 201 through overburden 202 and 203 into coal seam 204 with the drill hole bottomed a few inches above the lower boundary of the coal seam. The drill hole diameter could be, for example, 18 inches. As illustrated two strings of casing are used, a conductor casing 205 and a bobtail string 206. Casing 205 could be, for example, 13⅜ inches in diameter and casing 206 could be, for example, 10¾ inches in diameter. The casing strings are cemented 211 in place, preferably by injecting cement within the casing, and thus forcing cement to flow from bottom to the ground surface in the annulus between the casing and the well bore. Cementing procedures used are those common in the petroleum industry and in completing geothermal wells. The casing with its protective concrete lining located in coal seam 204 will be subjected to unusual stresses, therefore it is desirable to take steps beyond standard cementing practices. Apparatus 215 is added to increase the fidelity of the bond between the cement and the casing.

In preparing well 225 for production, the cement below the bottom of the casing 210 is drilled out as is the cement plug 224. This leaves a few inches of exposed coal below the original well bore, the space being used to establish a communication channel at the bottom of the seam to a nearby well that has been completed in the same manner as well 225. In bringing the well 225 on production, tubing 212 is inserted through wellhead 213 and bottomed near the interface 209 of the concrete and the coal. When well 225 is used as the reactants injection well, tubing 212 will remain relatively cool, but with the excess of oxygen available at the discharge point of the tubing, the coal immediately surrounding the well bore will burn a void space around the protective cement. This void space will cause the cement to undergo thermal stresses, hence the requirement for a good bond to the casing. When well 225 is used for a producer well, hot gases from the reactor are removed from the well through tubing 212 and it is important that the bottom joints of tubing be of heat resistant material. In severe cases it may be necessary to provide cooling to the casing and tubing, which can be accomplished by injecting water into the annulus between the two (not shown). It will be noted that bonding apparatus 215 is shown in the bonding position while bonding apparatus 217 in the overlap section of the casings is shown in the retracted position.

Figure 3A:
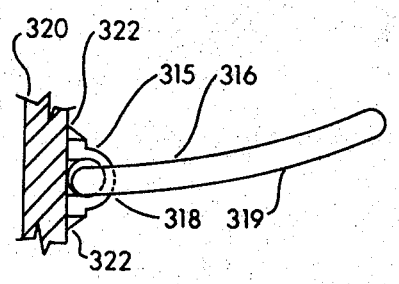
FIG. 3A is cross section side view of bonding apparatus affixed to the casing.
Figure 3B:
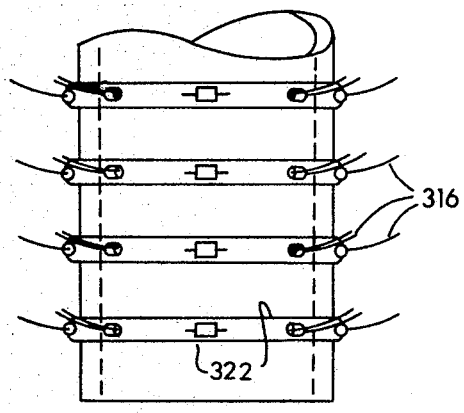
FIG. 3B is side view of a portion of the casing affixed with four sets of bonding apparatus.
Figure 3C:
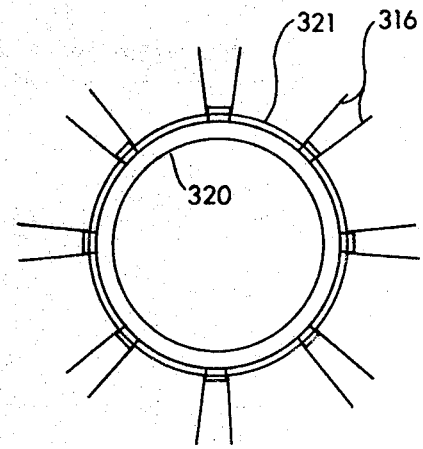
FIG. 3C is cross section plan view of the casing with one set of bonding apparatus.

Referring to FIG. 3, metal projections of the bonding apparatus, identified as 215, 216 and 217 in the previous drawing, are identified as 316. The bonding apparatus is designed for installation at the ground surface prior to placing the casing in the well bore. The projection finger is designed to retract during lowering casing 206 through casing 205, then extend outwardly in a locked position once the finger clears casing 205.

The projecting fingers 316 are constructed from preferably ⅜ inch steel rod and are of one piece construction making a pair of fingers with a center bearing surface, for example, 2 inches long between the fingers, the bearing surface being retained within a bracket 315 attached to hoop 321. A multiplicity of brackets with installed fingers is suitably affixed to hoop 321 which in turn is attached to casing 320. Preferably the fingers are formed in the shape of a shallow arc that removes the tip of the finger from contact with the outer casing when the finger is in the retracted position. The number of pairs of fingers on a hoop and the number of hoops affixed to the casing are selected with due regard to providing reinforcing and bonding requirements for the type of reinforced concrete being used, for example in a typical concrete, for each foot of casing three hoops are installed containing eight pairs of fingers. Preferably the curvature of the fingers is selected so that moderate compressive force is placed on the arc when the finger is retracted and is being lowered through the conductor casing. In this manner the fingers will serve as centralizers and will snap outwardly upon clearing the conductor casing. The fingers will fall by gravity to the extended position, being restrained from further rotation by lip 318 on bracket 315. Preferably fingers 316 lock in place upon rotating from the retracted position to the extended position, in order to assure remaining in the extended position upon being engulfed with cement grout. A suitable locking device may be selected from several commercially available, but preferably is of the type that may be manually unlocked prior to lowering the casing into the well but easily locks upon snapping into place by gravity, with a lock strength sufficient to overcome the force of an ascending cement column during grouting.

In some cases it may be desirable to install the bonding apparatus arrangement to conductor casing 205 as well as to increase the size of the well bore to provide a thicker section of cement. Such arrangements are desirable when the well is planned to be deepened into one or more underlying seams whose production will cause multiple waves of subsidence forces. In some locations in western United States, production of coal from multiple seams could result in subsidence as much as 200 feet at the surface. Under this extreme circumstance it would be necessary to cut off a portion of the casing, perhaps on several occasions, to lower the well head to a convenient height.

Figure 4:
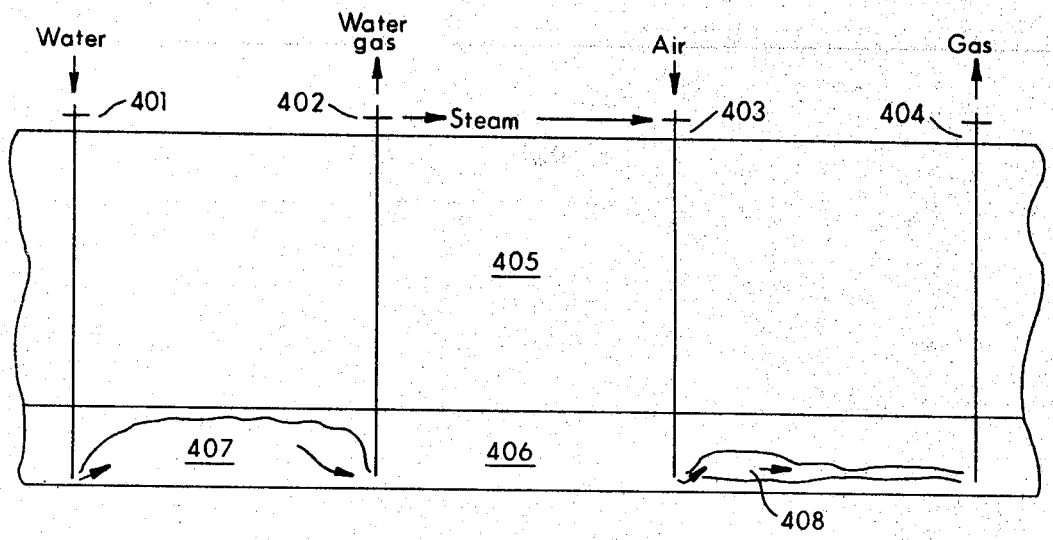
FIG. 4 is a diagrammatical vertical section through the earth showing module quenching in one georeactor and production in a nearby georeactor.

Referring to FIG. 4, two pairs of wells are shown drilled through overburden 405 and into coal seam 406. Georeactor 407 is nearing economic exhaustion, unproduced coal between wells 402 and 403 has been left in place for future production and georeactor 408 is in the early stages of production. It is desired to quench the module of georeactor 407 in preparation for backfill as previously described. Water is injected into well 401 which reacts with remnant hot coal in reactor 407 to produce water gas which is recovered as product gas. Since the air blow/steam run procedure has been terminated, the endothermic water gas reaction will lower the temperature of the hot coal and ultimately terminate the water gas reaction. During the cooling period the components of produced fluid recovered from well 402 will shift from water gas to water gas and steam, then finally to steam at about 1200° F. In order to assure that the module is quenched, temperature must be lowered below the ignition temperature of remnant coal, that is, a temperature below about 800° F. A considerable amount of sensible heat associated with module 407 may be recovered by continuing water injection until the quality of the steam is unsuitable for commercial use. Thus the steam generated in module 407 cooldown may be made from untreated water with produced steam used for the steam run in active module 408. When used in this manner well 402 is shut in during the repetitive air blows in well 403 and opened for the repetitive steam runs of georeactor 408.

Figure 5:
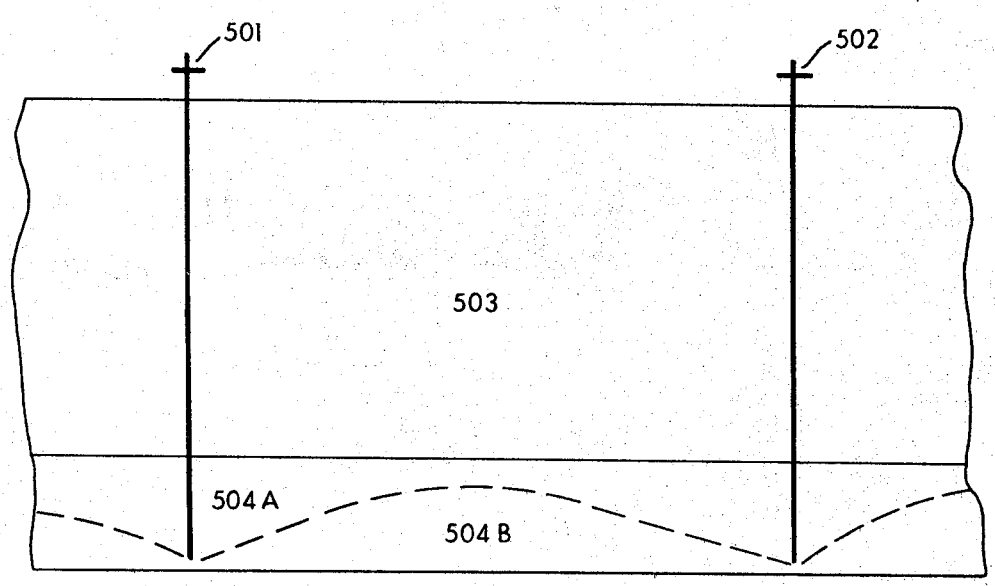
FIG. 5 is a diagrammatical vertical section through the earth showing a pair of wells in a wet coal seam prior to establishing a georeactor between the wells.

Referring to FIG. 5, wells 501 and 502 have been drilled through overburden 503 and into coal seam 504 which is an aquifer. After a considerable amount of pumping the localized water table has been lowered to the level indicated by the dashed line. Coal 504A is relatively dry in that flowable water has been removed. Coal 504B remains relatively wet with flowable water remaining in multiple angles of repose. Should linkage be attempted by a reverse burn in the coal between wells 501 and 502, conditions favor burning in the relatively dry coal 504A and thus the linkage will not be in the desired location at the bottom of the seam. If conditions are otherwise favorable for a reverse burn linkage, such as a thin shale break near the bottom of the seam, then steps must be taken to lower the water table to near the bottom of the seam. The procedure begins by opening well 501 and injecting a gas containing little or no oxygen, preferably carbon dioxide or nitrogen or a mixture thereof. With well 502 shut in, inert gas is injected into well 501 until the localized coal seam pressure comes up to near fracturing level, for example one pound per square inch of pressure for each foot of depth to coal seam 504. Injection in well 501 continues at the selected near fracturing pressure and water is produced through well 502 by holding a lesser back pressure on well 502. The procedure continues until water no longer flows out of well 502 when no back pressure is held in well 502. The remainder of water in the vicinity of well 502 may then be removed by pumping until drawdown occurs.

Figure 6:
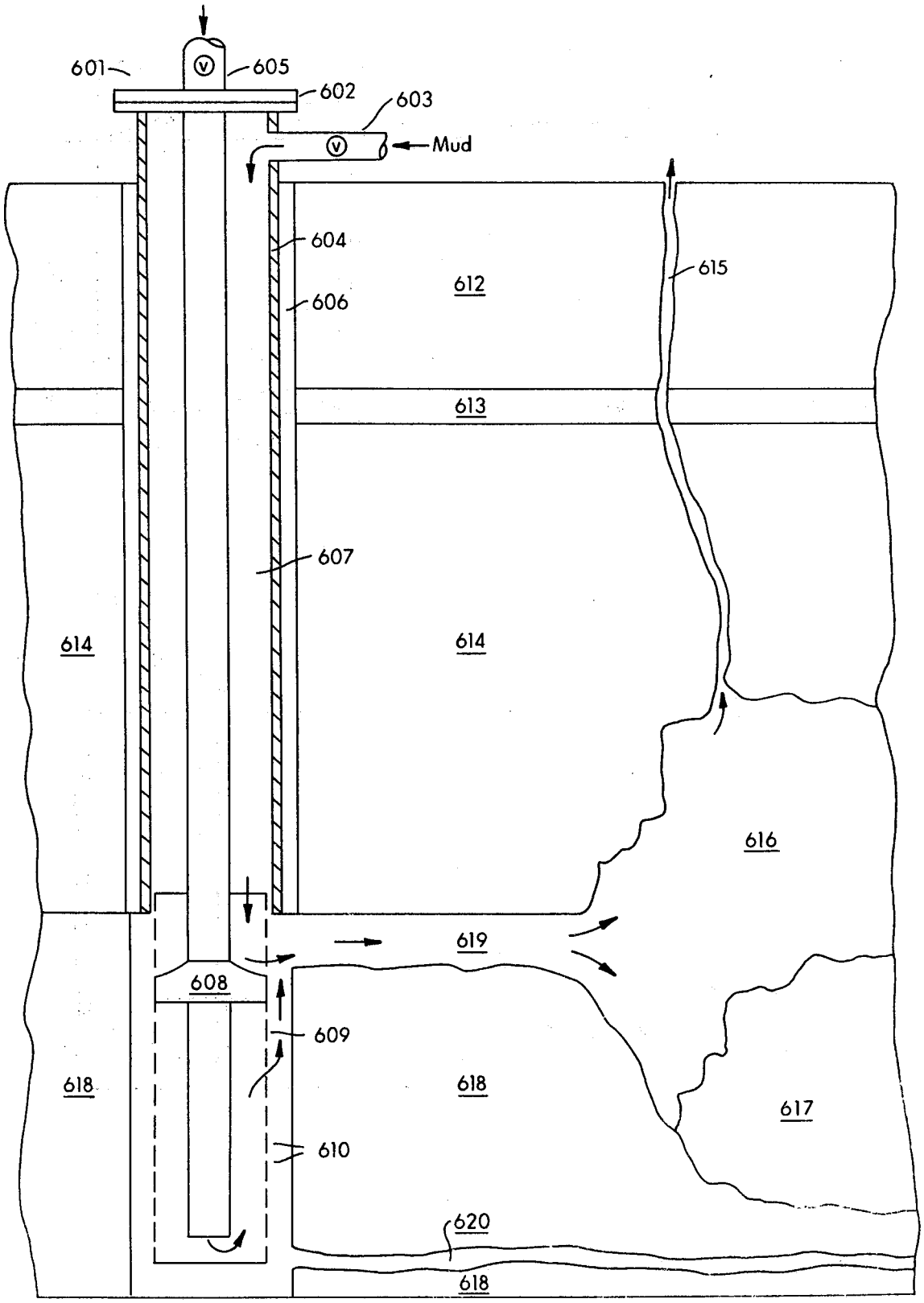
FIG. 6 is a diagrammatical vertical section through the earth showing arrangement of apparatus for placing a seal above the georeactor.

Referring to FIG. 6, one well of a pair of wells is shown at a time when the georeactor had been operating in an undesirable flame override mode for an extended period. Well 601 was drilled from the surface of the earth through overburden 612, aquifer 613 and overburden 614. Casing 604 was set to the top of coal 618 and cemented 606 to the surface. The well was then deepened to the bottom of coal seam 618 and linkage channel 620 was established to the nearby well which served as an injector well to the georeactor. In the course of production, the burn preferentially moved from the linkage channel 620 to a higher location in the seam, burning a cavity in the upper portion of the seam and with burn-through to well 601 occurring at the top of the seam in channel 619. In overburden 614 both roof fall and subsidence have occurred resulting in cavity 616, rubble pile 617 and subsidence crack 615. The georeactor between the wells has lost its pressurized integrity through open channel 615 to the atmosphere, and cavity 616 adds a nonproductive volume to the reactor. In addition water from aquifer 613 is free to flow into the reactor and its hot environment.

For remedial action both wells are shut in and some dirt work may be done at the surface to limit the lateral extent of the subsidence crack. Initially it is desirable to have water incursion into the reactor to quench the module, and quenching can be hastened by injection water into one or both of the wells, with steam venting through crack 615. When the georeactor is cooled to the planned temperature, well 601 is equipped with a sealant mud liner as shown in FIG. 6. The liner is composed of tubing 605, hung from flange 602 and bottomed near original linkage channel 620. Affixed to tubing 605 is mud deflector 608 composed of an upper swage connected to a lower collar, positioned near the bottom of channel 619. Affixed to mud deflector 608 is mud screen 609 which is a perforated 610 metal cylinder, positioned from a point within casing 604 to a point slightly below the bottom of tubing 605. Mud injection pipe 603 is located near the upper end of casing 604.

The sealing procedure begins by shutting in the nearby well, then injecting sealant mud via pipe 603 into annulus 607. Sealant mud may be of any suitable type but preferably is the type identified in the discussion of FIG. 1 in a foregoing section. Initially the injected mud is allowed to flow by gravity through mud screen 609 and into the bottom of well 601, thus partially plugging linkage 620.

Sealing continues with injection of mud through pipe 603 and with injection of inert gas into well 601 through tubing 605. The inert gas preferably is carbon dioxide, nitrogen or a mixture of the two. Pressure of the inert gas is established at a value preferably slightly below the pressure of the column of mud as it approaches mud deflector 608. Pressure of the georeactor, with the open vent to the atmosphere, is considerably below that of the injected mud and injected inert gas, therefore the sealant mud will flow under a gas driven into channel 619. With continued injections the mud will engulf rubble pile 617 and begin ascending into cavity 616. Mudding continues in this manner until injection pressures show a marked rise, signalling that the mud refusal point is near. Injection of mud and inert gas is terminated, and is immediately followed by injections of slugs of water both in annulus 607 and tubing 605 to flush mobile mud out of well 601. At this point tubing 605, with attached mud deflector and mud screen, is removed from well 601. The system is then shut in to allow time for the foaming mud to expand to its final position and properly set.

With the seal thus placed on the reactor, subsidence crack 615 is sealed from the bottom up, excluding aquifer 613 from the georeactor, cavity 616 is substantially filled, channel 619 is plugged, and rubble pile 617 is sealed. Well 601 is reentered and accumulated cement is drilled through to the original bottom of the hole. The drill bit is removed and a perforating gun is lowered to the bottom of the hole and fired as necessary to reopen linkage channel 620. The gun is removed, well 601 is reequipped for production, coal 618 is reignited and production resumes with a growing georeactor in channel 620.

Figure 7:
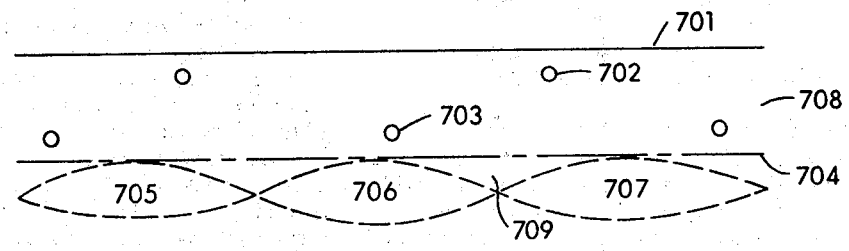
FIG. 7 is a plan view showing a possible well pattern for the barrier pillar.

Referring to FIG. 7, a plan view is shown of a portion of the project property limit 701, the location of the barrier pillar 708, outer water interceptor wells 702, inner water interceptor wells 703, minimum width of the barrier pillar 704, and the locations of underground georeactors 705, 706 and 707. The barrier pillar, as previously mentioned in a strip of unmined coal left at the perimeter of the property. The outside boundary of the barrier pillar can be a straight line coinciding with the property limit. The inner boundary of the barrier pillar is a theoretical straight line 704, which is the minimum planned width of the pillar, for example 150 feet. Actual inner boundary of the pillar is controlled by the shape of the georeactors for in situ production. The inner boundary is irregular with unproduced coal 709 occurring along the line.

The barrier pillar is left to provide a buffer between the project and adjacent property. Migration of water in aquifers located above the coal seam is of concern. Water flowing into the project may cause a problem with underground georeactors during subsidence disturbances. Water flowing out of the project may be contaminated and thus should not be allowed to flow untreated into neighboring properties. Thus water flowing into the project site may be intercepted by maintaining localized drawdown of the water table by producing water from wells in the barrier pillar. Likewise contaminated water flowing out of the project site can be intercepted by pumping the wells, with produced water being directed to water treating facilities prior to further use.

In some cases it may be desirable to block the flow of water through the barrier pillar area. In these cases the wells in the barrier pillar are used to inject mud in the aquifer, plugging the permeability of the formation. Such mud preferably is a slush mud slurry composed of water and fine clay, with a slurry solids content in the range of 10 to 50%. Sealant mud, as described previously, may also be used for this purpose. Plugging the aquifer is accomplished by injecting the slurry into one well, for example well 702, and opening a nearby well, for example well 703, and continuing slurry injection to refusal. This procedure continues until all wells in the pillar have been subjected to injection of the slurry to refusal. As a practical matter it is desirable to test the wells from time to time to assure that the seal remains, and if seal failure has occurred at any well such well should be re-mudded.

Figure 8A:
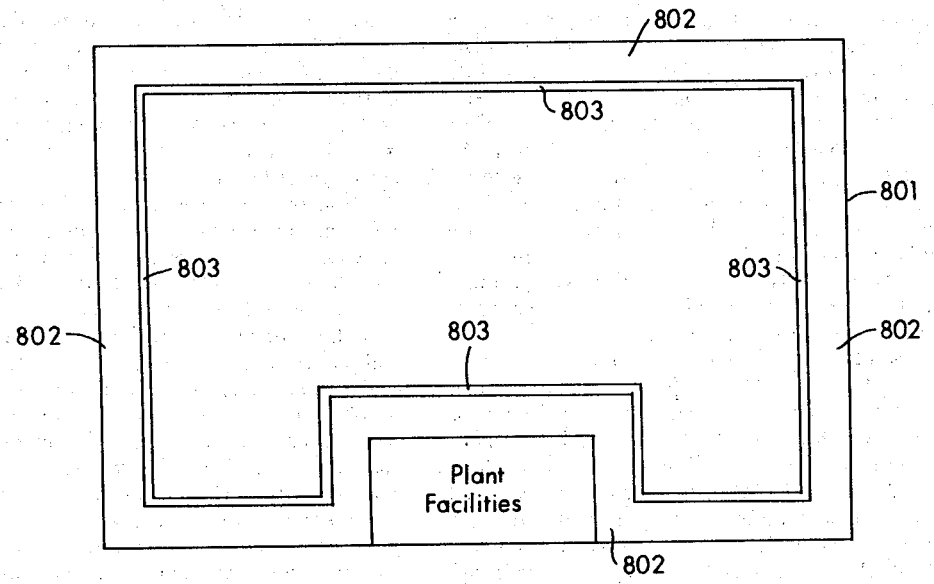
FIG. 8A is a plan view of the barrier pillar showing location of subsidence draw protective trench.

Referring to FIG. 8A, a plan view of the project site is shown, including site perimeter 801, barrier pillar area 802 and subsidence draw protective trench 803. Trench 803 is dug to provide a discontinuity in the surface rock to a depth designed to protect surface installations from destructive forces of subsidence draw. The depth of trench 803 may vary from place to place on the site, for example the trench should be at least as deep around plant facilities as the lowermost portion of the foundations for structures within the plant facilities. It is common to locate service roads above the barrier pillar and a fence on the property periphery, thus the trench may be somewhat shallower in these locations as compared to the trench depth around plant facilities.

Figure 8B:
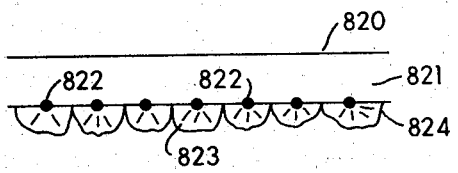
FIG. 8B is a diagrammatical vertical section through the earth showing subsidence draw protective trench with explosive fracturing.

FIG. 8B is a vertical section showing the ground surface 820 and trench 821 dug to depth 824. To provide additional depth to the discontinuities, explosive charges 822 are placed in the bottom of the trench. Explosive charges preferably are of the slow burning type, for example black powder, are spaced apart an appropriate distance, for example in the range of 5 to 10 feet, and of appropriate size, for example in the range of one-half to one pound. Preferably the charges are positioned, the trench is filled with excavation material and the charges are detonated. Resulting rock fracturing adds to the protection against lateral surface rock shifts during applied forces of subsidence draw.

Thus it may be seen that a system of methods may be employed to minimize the effects of subsidence during production of coal in situ. In applying such methods problems become manageable in georeactor integrity including product gas leakage, ground water contamination and module quenching. It will be appreciated that this invention is not limited to any theory of operation, but that any theory that has been advanced is merely to facilitate disclosure of the invention. While the present invention has been described with a certain degree of particularity, it is understood that the present disclosure has been made by way of example and that changes in details of structure may be made without departing from the spirit thereof.

What is claimed is:

1. A method of establishing a production well to withstand stresses induced by consumption of coal in situ, comprising the steps of drilling a bore hole from the surface of the earth through the overburden and substantially through the coal seam, installing conductor casing within the bore hole to a point adjacent to the interface of the overburden and the coal seam, installing bonding apparatus to a bobtail string of casing, the bonding apparatus containing a multiplicity of rotatable projecting fingers capable both of retracting to positions substantially parallel to the bobtail string of casing and of extending to positions substantially perpendicular to the bobtail string of casing, the bobtail string being of sufficient length to reach the bottom of the bore hole and overlap into the conductor casing, lowering the bobtailed string of casing within the conductor casing to the bottom of the bore hole, then cementing the conductor casing and the bobtail string of casing into place, wherein the cement completely fills the annulus between the conductor casing and the bore hole, wherein the cement completely fills the annulus between the overlapping portion of the conductor casing and the bobtail string of casing and the cement engulfs the retracted projecting fingers located within the said overlapping portion, and wherein the cement completely fills the annulus between the bobtail string of casing and the bore hole and the cement engulf the extended projecting fingers located below the conductor casing.

2. The method of claim 1, further including the step of retracting all of the projecting fingers prior to lowering the bobtail string through the conductor casing, with the resultant use of the projecting fingers serving as centralizers during lowering of the bobtail string through the conductor casing.

3. The method of claim 1, including the step of providing a cement plug at the bottom of the bobtail string and further including the steps of drilling out the cement plug beneath the lower end of the bobtail string and deepening the bore hole to the bottom of the coal seam, then establishing a linkage channel in the coal seam.

* * * * *